United States Patent [19]

Bailey

[11] 3,991,444

[45] Nov. 16, 1976

[54] RELEASABLE CABLE TIE

[75] Inventor: Michael S. Bailey, Palos Hills, Ill.

[73] Assignee: Panduit Corporation, Tinley Park, Ill.

[22] Filed: Feb. 18, 1976

[21] Appl. No.: 659,174

[52] U.S. Cl. ..... 24/16 PB
[51] Int. Cl.[2] ..... B65D 63/02
[58] Field of Search ..... 248/74 PB; 24/16 PB, 24/17 AP, 73 PB, 30.5 P

[56] References Cited

UNITED STATES PATENTS

| | | | |
|---|---|---|---|
| 2,884,214 | 4/1959 | Wrobel | 24/16 PB UX |
| 3,009,220 | 11/1961 | Fein | 24/16 PB |
| 3,049,778 | 8/1962 | Weckesser | 24/16 PB UX |
| 3,106,028 | 10/1963 | Baumgartner | 24/16 PB X |
| 3,302,913 | 2/1967 | Collyer et al. | 24/73 PB UX |
| 3,542,321 | 11/1970 | Kahabka | 24/16 PB X |
| 3,667,710 | 6/1972 | Moody et al. | 248/74 PB X |
| 3,731,347 | 5/1973 | Caveney et al. | 24/16 PB |
| 3,766,608 | 10/1973 | Fay | 24/16 PB |

*Primary Examiner*—Donald A. Griffin
*Attorney, Agent, or Firm*—Charles R. Wentzel; Richard B. Wakely

[57] ABSTRACT

A releasable cable tie for forming a plurality of elongate objects such as wires into a bundle. The tie includes an elongate strap and a locking head which has strap entry and exit faces, a strap-receiving aperture extending between the faces and having a predetermined strap pass path therethrough, and a locking pawl extending into the aperture and toward the strap exit face for holding the strap. The pawl is movable between a release position wherein it is adjacent the strap exit face and disposed outside the strap pass path and an engagement position wherein the pawl is disposed adjacent the strap entry face and securely holds the strap. The cable tie further includes a fulcrum extending toward the strap exit face and a release arm extending from the pawl comprising a generally rigid lever and a generally flexible hinge joining the lever to the pawl. A portion of the lever adjacent the hinge is engagable with the fulcrum when the pawl is in its engagement position whereby the operator by applying force to the distal end of the lever is provided with a mechanical advantage thereby facilitating movement of the pawl to its release position.

10 Claims, 6 Drawing Figures

RELEASABLE CABLE TIE

BACKGROUND OF THE INVENTION

This invention relates to one-piece cable ties and more particularly to such ties having release means for releasing the tie after it has been tightened. One-piece plastic cable ties for bundling a plurality of elongate objects such as wires have come into common use in the last two decades. Such ties typically include a locking head having a toothed locking pawl pivotally mounted and extending into a strap-receiving aperture, and a strap having a series of transverse teeth on one surface thereof for engagement with the pawl. These prior art ties are available in both releasable and non-releasable versions with the former generally having a short lever or tab extending from the pawl beyond the strap exit face of the locking head. In releasing the tie, the strap must be pulled at least a short distance through the locking head in the strap tightening direction to allow the pawl to pivot toward the strap exit face and out of engagement with the strap. Of course, the force required to release the strap is a function of the force previously used in applying the tie.

In one type of prior art releasable cable tie, the lever was somewhat rigid and, after tightening, was positioned adjacent the excess threaded portion of the strap. The user preferably deflected the tail of the strap away from the lever to catch the lever with his fingernail. Examples of such cable ties are disclosed in commonly-assigned U.S. Pat. Nos. 3,667,710 and 3,731,347.

In another type of prior art tie, the release lever was slightly longer and was more supple, being intended for grasping between the fingers. If the user's fingers were wet or oily, such a lever was difficult to grasp effectively. Especially if the cable tie had previously been highly tensioned, the fingers could easily slip off the lever and the user was required to resort to the use of a tool, e.g., a pliers, to release the tie.

A cable tie having a ladder-type strap has recently been proposed, the strap comprising two spaced side rails joined by a plurality of spaced rungs. In contrast to the toothed strap wherein the pawl extended only partially into the strap pass path, the pawl used with a ladder-type strap must extend a greater distance through the strap to effectively engage a rung and could extend well beyond the strap. It will be appreciated that with such greater pawl extension, the strap must be pulled a greater distance in the strap-tightening direction to release the pawl of a tie having a ladder strap. Accordingly, it would be difficult for a pawl having a prior art release lever to be moved sufficiently to release a ladder strap especially if the strap has been applied with a moderately high tension.

SUMMARY OF THE INVENTION

Among the several objects of the present invention may be noted the provision of an improved cable tie having release means operable to conveniently release the strap even after the strap has been moderately tensioned; the provision of such a cable tie which gives to user a mechanical advantage to facilitate moving the locking pawl out of engagement with the strap; the provision of such a cable which allows the user to engage the release lever without deflecting the tail of the strap away from the lever; and the provision of such a cable tie which is convenient and reliable in use, inexpensive, has long service life, and is simple and economical to manufacture. Other objects and advantageous features of the invention will be in part apparent and in part pointed out hereinafter in the specification and the claims attendant thereto.

Briefly, the releasable cable tie of the present invention includes an elongate strap, a locking head having a pawl, a fulcrum, and a release arm extending from the head and engagable with the fulcrum. The head includes strap entry and exit faces and a strap-receiving aperture extending between the faces and including a predetermined strap pass path therethrough. The locking pawl extends into the aperture and toward the strap exit face and is movable between a first position wherein it is adjacent the strap exit face and disposed outside the strap pass path and a second position wherein the pawl is disposed adjacent the strap-entry face and securely holds the strap. The fulcrum extends toward the strap exit face. The release arm comprises a relatively rigid lever and a relatively flexible hinge joining the lever to the pawl. A portion of the lever adjacent the hinge is engagable with the fulcrum when the pawl is in its engagement position whereby the user, by applying force to the distal end of the lever, is provided with a mechanical advantage thereby facilitating movement of the pawl to its release position.

DESCRIPTION OF THE PREFERRED EMBODIMENT

Figure 1:
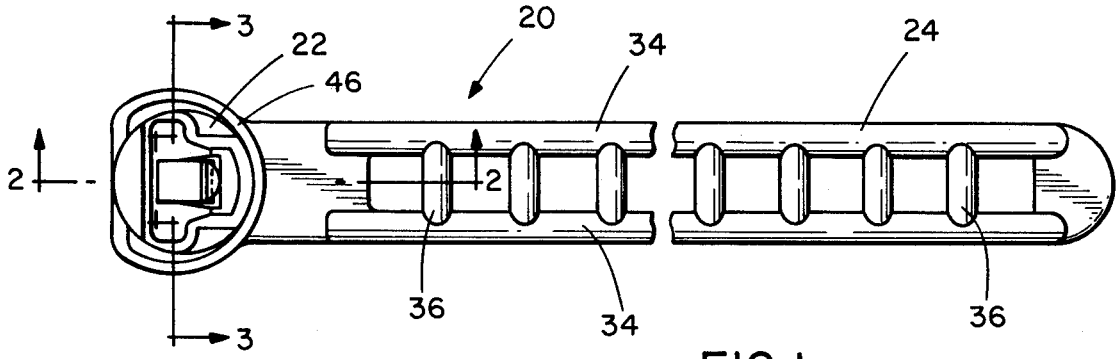
FIG. 1 is a plan of a releasable self-locking cable tie of the present invention including a strap and a locking head.
Figure 2:
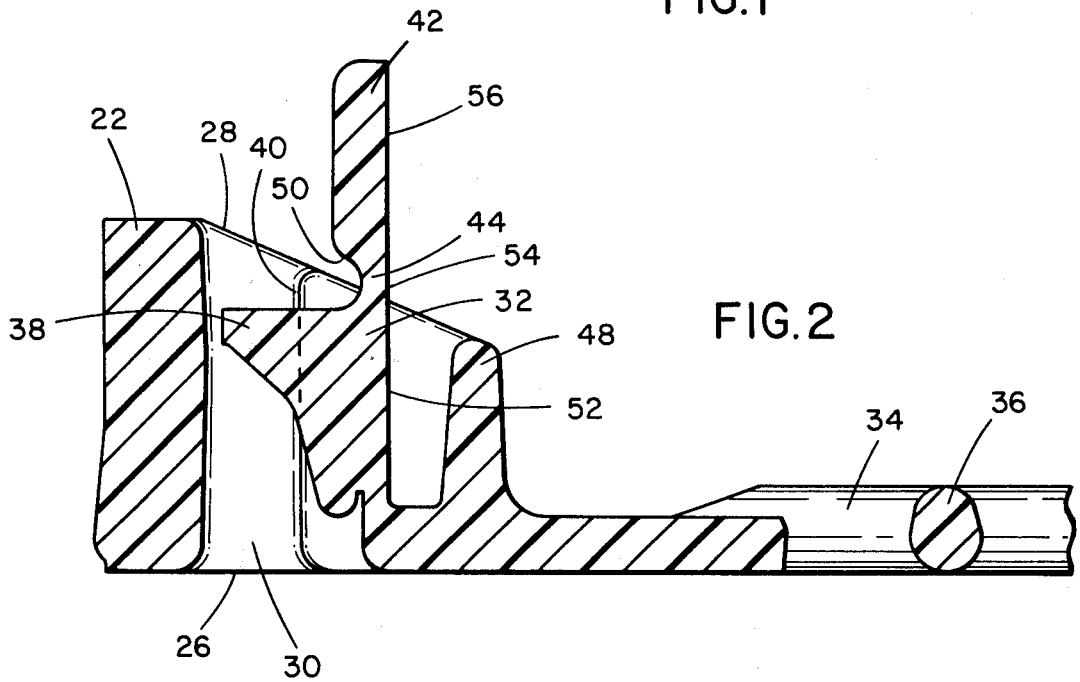
FIG. 2 is a an enlarged sectional view taken generally along line 2—2 showing a locking pawl carried by the head having a release arm extending therefrom and further showing a fulcrum engagable by the release arm.
Figure 3:
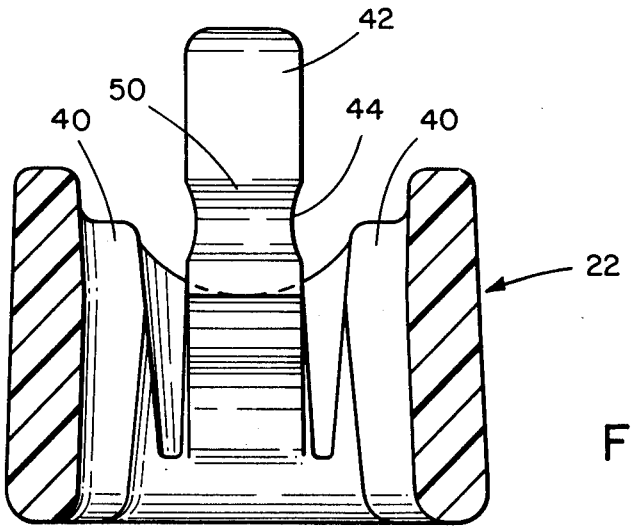
FIG. 3 is an enlarged sectional view taken generally along line 3—3 of FIG. 1.

Referring now to the drawings, a one-piece, self-locking cable tie for forming a plurality of elongate objects such as wires into a bundle typically of circular cross-section is generally indicated by reference numeral 20. Cable tie 20 is preferably integral and molded of a thermoplastic material such as nylon and includes a locking head 22 and an elongate strap 24 extending therefrom. As best shown in FIG. 2, locking head 22 comprises a strap entrance face 26, a strap exit face 28, a strap-receiving aperture 30 extending between the faces and having a predetermined strap pass path therethrough, and a locking pawl 32 pivotally joined to the head and extending into the aperture and toward the strap exit face. Of course, the term "pivotal" is to be accorded its broad meaning. That is, the term "pivotal", when used in the context of a one-piece plastic cable tie, is understood to include some flexing in addition to rotation about an imaginary hinge. Strap 24 comprises a pair of longitudinally extending side rails 34 joined by a plurality of spaced rings 36 engagable with pawl 32.

Locking pawl 32 includes a nose 38 for engaging a predetermined rung thereby to hold the strap 24 after it has been threaded through head aperture 30 when strap withdrawal forces are applied. More specifically, pawl 32 is movable between a release position shown in FIG. 6 wherein nose 38 is adjacent strap exit face 28 and is disposed outside of the strap pass path and an engagement position, shown in FIG. 4, wherein the nose is adjacent or closer the strap entry face and is positioned to extend into the strap pass path and securely engages one of the rungs 36 to oppose retrograde movement of the strap through locking head 22. Locking head 22 also includes a pair of transverse rails 40 extending into aperture 30 and straddling pawl 32 for limiting movement of strap 24 towards the pawl.

Extending from pawl 32 beyond strap exit face 28 is a release arm comprising a relatively rigid lever 42 and a relatively flexible hinge section 44 disposed intermediate the pawl and the lever. Locking head 22 includes a rim 46 extending toward the strap exit face a portion 48 of which is disposed between pawl 32 and strap 24 in its as-molded position. Portion 48 is engagable with the release arm and, as will appear hereinafter, serves as a fulcrum for lever 42.

Figure 4:
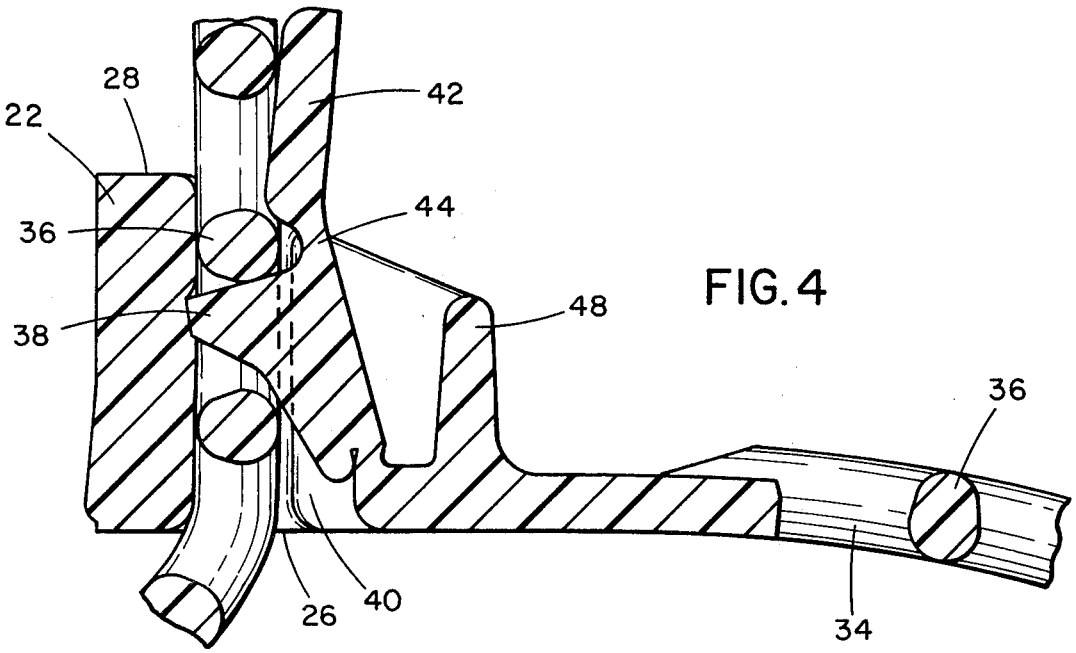
FIG. 4, similar to FIG. 2, shows the release arm being deflected by the strap after the strap has been threaded through the locking head.

More specifically, as shown in FIG. 2, the release arm in its as-molded position extends generally perpendicularly to the longitudinal direction of the strap 24. Its spacing from the strap pass path and from the pivot point of the pawl is such that, as shown in FIG. 4, when the pawl 32 is in its engagement position, lever 42 interferes with the excess threaded portion of the strap causing hinge 44 to bend and an intermediate portion of lever 42 (between the distal end of the lever and hinge 44) to engage the strap. This results in the distal end of lever 42 being positioned out of engagement with the strap so that it can conveniently be engaged as by the user's fingernail. Of course, the spacing between the free end of lever 42 and the strap can be increased by lengthening lever 42. The release arm includes a surface 50, remote from fulcrum 48, which serves as an abutment or fingergrip to facilitate moving lever 42 away from nose 38. As shown in FIG. 2, pawl 32, hinge 44, and lever 42 include respective back surfaces 52, 54, 56 all of which are substantially coplanar in the as-molded position of cable tie 20.

Figure 5:
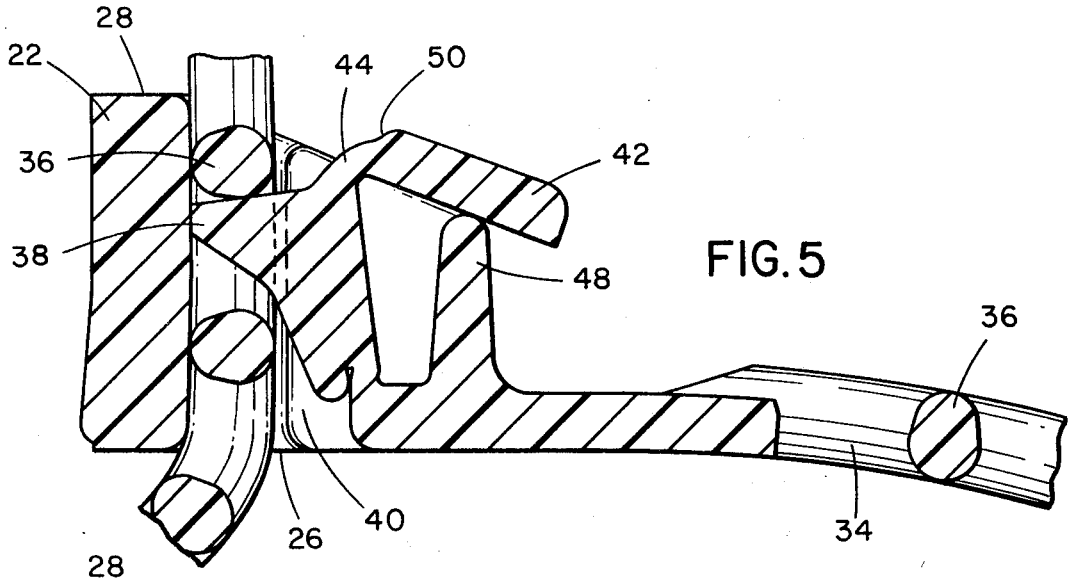
FIG. 5, similar to FIG. 2, shows the lever deflected into engagement with the fulcrum.
Figure 6:
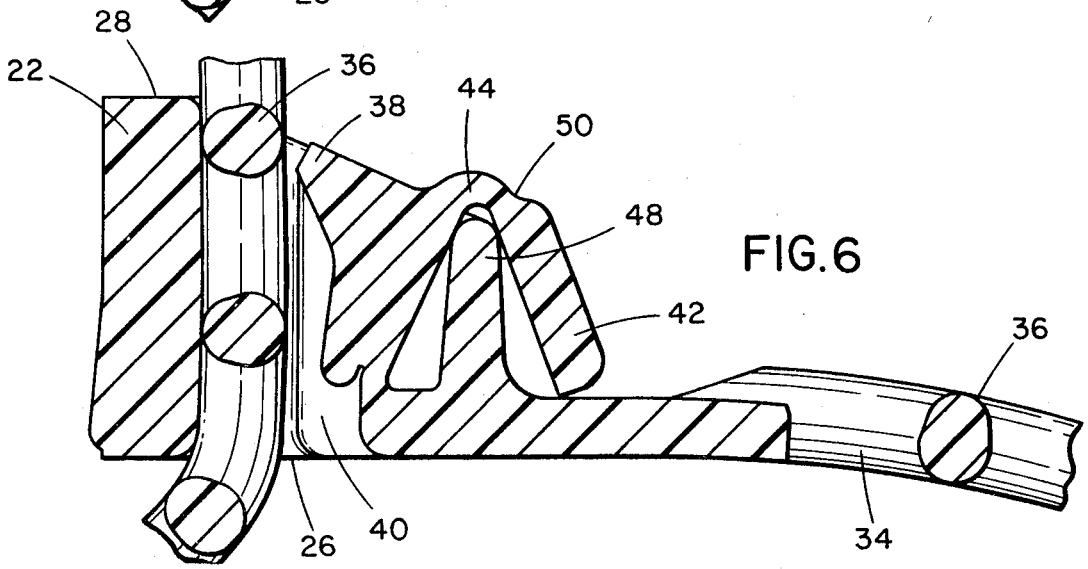
FIG. 6, also similar to FIG. 2, shows the pawl in its release position. Corresponding reference numerals indicate corresponding components throughout the several views of the drawings.

Operation of cable tie 20 is as follows: After the strap 24 has been disposed about the wires and has been threaded through locking head 22, the resiliency of the wires and of strap 24 cause the application of strap withdrawal forces to nose 38 which is shaped and biased to extend between adjacent rungs 36 of the strap. As the pawl 32 pivots towards its engagement position, shown in FIG. 4, lever 42, due to the biasing of hinge 44, engages the excess threaded portion of the strap causing hinge 44 to flex and the distal end of lever 42 to be at least slightly spaced from the strap. When strap release is desired, the user simply catches the free end of lever 42 with his fingernail and deflects the lever into engagement with fulcrum 48 as shown in FIG. 5. It is noted that as the end of the lever is spaced from the strap, the user is not first required to deflect the strap away from the release arm as was required in prior art releasable cable ties. By applying force against abutment surface 50, the user causes lever 42 to slide on the fulcrum away from the excess threaded portion of the strap. This in turn causes the pawl 32 to pivot towards its release position and nose 38 to move the strap in the strap-tightening direction. It will be appreciated that increasing forces are required to move the pawl as nose 38 lifts the engaged rung 36 because movement of the pawl increases the tension applied to the bundle. However, the lever-fulcrum arrangement of the present invention affords the user a mechanical advantage in the final part of movement of the pawl towards its release position. More specifically, once the longitudinal mid-point of the relatively rigid lever has moved away from the pawl and past fulcrum 48, force applied to the distal end of lever 42 will result in a greater force applied by the connected end of the lever due to the characteristics of a lever-fulcrum structure. Thus by merely pushing on the free end of the lever, the user can easily complete movement of the pawl to its release position. As shown in FIG. 6, with pawl 32 in its release position and lever 42 deflected, surfaces 52, 54, and 56 define a pocket receiving fulcrum 48.

It will be appreciated that with the ladder strap arrangement illustrated, the pawl when in its engagement position may extend completely through the strap. Thus, release of the strap requires greater movement of the strap in the strap-tightening direction than in a cable tie arrangement wherein the pawl extends only partially through the strap. The release arm can be used to release a loosely or moderately tightened ladder strap; however, a strap under high tension, e.g., near the ultimate failure tension of the tie, could not be released.

A similar but non-releasable ladder-type cable tie is disclosed in commonly-assigned U.S. patent application Ser. No. 588,273, filed June 19, 1975.

It should be understood that the release arm and fulcrum described above can advantageously be used with many types of cable ties other than the ladder-type cable tie above described.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limting sense.

What is claimed is:

1. A releasable cable tie for forming a plurality of elongate objects such as wires into a bundle, said cable tie comprising an elongate strap and a locking head, said head including a strap entry face, a strap exit face, a strap-receiving aperture extending between said faces and having a predetermined strap pass path therethrough, and a locking pawl extending into said aperture and toward said strap exit face for holding said strap, said pawl being movable between a release position wherein it is adjacent said strap exit face and disposed outside of the strap pass path and an engagemnt position wherein said pawl is disposed adjacent said strap entry face and securely holds said strap, said cable tie further including a fulcrum and a release arm extending from said pawl comprising a generally rigid lever and a generally flexible hinge joining said lever to said pawl, a portion of said lever adjacent said hinge being engagable with the fulcrum when the pawl is in its engagement position whereby the operator by applying force to the distal end of said lever is provided with a mechanical advantage thereby facilitating movement of the pawl towards its strap-releasing position.

2. A cable tie as set forth in claim 1 wherein said fulcrum extends from adjacent the strap entry face towards the strap exit face.

3. A cable tie as set forth in claim 1 wherein said locking head includes a rim comprising said fulcrum.

4. A cable tie as set forth in claim 1 wherein said tie is of one-piece construction and is made of a molded thermoplastic material.

5. A cable tie as set forth in claim 1 wherein said lever is deflectable away from the excess threaded portion of said strap and in its deflected position defines, with said hinge and said pawl, a pocket for receiving said fulcrum, said fulcrum being received within said pocket when said lever is in its deflected position with said pawl in its release position.

6. A cable tie as set forth in claim 1 wherein said pawl, said hinge, and said lever, in their as-molded position, each have coplanar surfaces.

7. A cable tie as set forth in claim 1 wherein one surface of said lever is provided with at least one abutment serving as a fingergrip.

8. A cable tie as set forth in claim 7 wherein said abutment is on the surface on said lever disposed remote from said fulcrum.

9. A cable tie as set forth in claim 1 wherein said strap comprises a pair of longitudinally extending side rails joined by a plurality of spaced transverse rungs and wherein said pawl comprises a nose extending between adjacent rungs when the pawl is in its engagement position.

10. An improvement in a cable tie for forming a plurality of elongate objects such as wires into a bundle, said tie comprising a strap and a locking head having a strap entrance face, a strap exit face, a strap-receiving aperture extending between the faces, and a pivotal pawl for engaging the strap and extending into said aperture and toward said strap exit face, said aperture having a predetermined strap pass path therethrough, said pawl being movable between a first position wherein the pawl is adjacent the strap exit face and is disposed out of the strap pass path and a second position wherein the pawl is disposed adjacent the strap entrance face and engages and holds said strap, said improvement comprising:

an elongate release arm extending from the pawl and beyond said strap exit face, said arm including a substantially rigid lever and a substantially flexible hinge disposed intermediate said lever and said pawl, said hinge biasing said lever to interfere with the excess threaded portion of said strap when said pawl is in its second position and an intermediate portion of said lever engaging said strap whereby the distal end of said lever is deflected and spaced from the excess threaded portion of said strap thereby permitting the user to deflect the lever without first moving said strap away from said lever.

* * * * *

UNITED STATES PATENT AND TRADEMARK OFFICE

CERTIFICATE OF CORRECTION

PATENT NO. : 3991,444

DATED : November 16, 1976

INVENTOR(S) : Michael S. Bailey

It is certified that error appears in the above-identified patent and that said Letters Patent are hereby corrected as shown below:

Column 3, line 2: "rings" should be --rungs--.

Signed and Sealed this

Twelfth Day of April 1977

[SEAL]

*Attest:*

RUTH C. MASON
*Attesting Officer*

C. MARSHALL DANN
*Commissioner of Patents and Trademarks*